United States Patent [19]

Keil et al.

[11] 4,399,043

[45] Aug. 16, 1983

[54] FABRIC SOFTENER

[75] Inventors: Karl-Heinz Keil, Offenbach am Main; Adolf May, Hofheim am Taunus; Hans-Walter Bücking, Kelkheim, all of Fed. Rep. of Germany

[73] Assignee: Hoechst Aktiengesellschaft, Frankfurt, Fed. Rep. of Germany

[21] Appl. No.: 346,300

[22] Filed: Feb. 5, 1982

Related U.S. Application Data

[63] Continuation of Ser. No. 170,587, Jul. 21, 1980, abandoned.

[30] Foreign Application Priority Data

Jul. 25, 1979 [DE] Fed. Rep. of Germany ..... 2930111

[51] Int. Cl.[3] ..... D06M 13/18; D06M 13/32; D06M 13/46

[52] U.S. Cl. ..... 252/8.7; 252/8.75; 252/8.8; 252/8.9

[58] Field of Search ..... 252/8.7, 8.75, 8.9, 252/8.8

[56] References Cited

U.S. PATENT DOCUMENTS

| | | | |
|---|---|---|---|
| 3,607,765 | 9/1971 | Wixon | 252/8.8 |
| 3,997,453 | 12/1976 | Wixon | 252/8.8 |
| 4,134,838 | 1/1979 | Hopper et al. | 252/8.8 |
| 4,153,561 | 5/1979 | Humuller et al. | 252/8.7 |

FOREIGN PATENT DOCUMENTS

| | | |
|---|---|---|
| 1256640 | 12/1967 | Fed. Rep. of Germany . |
| 1370916 | 10/1974 | United Kingdom . |

*Primary Examiner*—Maria Parrish Tungol
*Attorney, Agent, or Firm*—Connolly and Hutz

[57] ABSTRACT

Fabric softeners which result in an improved rewettability of the textile material treated with the same and which are present in the form of an aqueous solution or dispersion containing from 3 to 15% by weight of one or several quaternary ammonium compounds and from 0.5 to 1.5% by weight of a compound of the formula

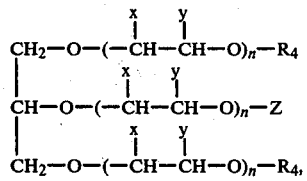

in which $R_4$ is alkyl or alkenyl of from 4 to 20 carbon atoms, cyclohexyl or aryl optionally substituted by alkyl groups, x and y are hydrogen or methyl, but are not methyl at the same time, n is a number of from 0 to 20, Z is a group of formula $-(CH_2)_mCOOMe$, $-SO_3Me$ or $-PO_3Me_2$, m is an integer of from 0 to 3, and Me is an alkali metal or ammonium ion, as well as optionally further common auxiliaries and additives.

3 Claims, No Drawings

FABRIC SOFTENER

CROSS REFERENCE TO RELATED APPLICATION

This application is a continuation of application Ser. No. 170,587 file July 21, 1980 and now abandoned.

It is known that textiles which have been washed, especially in an automatic washer, and particularly those made from cellulose fibers, are in an unpleasant hardened state after drying. This undesirably hardened feel can be overcome by treating the textiles after washing in a rinsing bath with cationic substances which contain at least two long-chain aliphatic radicals in the molecule. Especially the dialkyl-dimethylammonium salts dispersible in water have proved in practice to be suitable for this application. However, on overdosage, these products have the disadvantage of making the treated fabric hydrophobic, thus retarding rewetting.

It has now been found that these disadvantages are overcome by combining the quaternary ammonium compounds used as fabric softeners with a glycerol ether derivative. Subject of the invention are therefore fabric softeners in the form of an aqueous solution or dispersion which contain from 3 to 15, preferably 4 to 7, % by weight of one or more compounds of formulae I to III

I

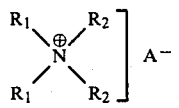

II

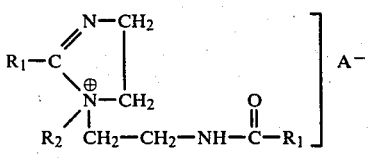

III

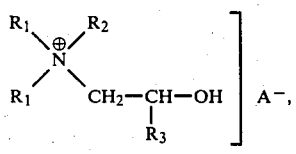

in which $R_1$ is alkyl or alkenyl of from 10 to 30 carbon atoms, preferably from 8 to 14 carbon atoms, $R_2$ is alkyl of from 1 to 4 carbon atoms, preferably methyl, $R_3$ is methyl or hydrogen, and A is an anion, such as $Cl^{(-)}$, $Br^{(-)}$, $CH_3OSO_3^{(-)}$ or $(CH_3O)_2PO_2^{(-)}$, from 0.1 to 3, preferably from 0.5 to 1.5, % by weight of a glycerol ether derivative of formula IV

IV

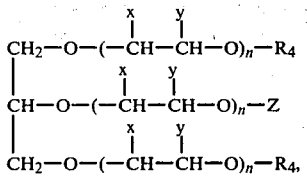

in which $R_4$ is alkyl or alkenyl of from 4 to 20 carbon atoms, preferably from 8 to 16 carbon atoms, cyclohexyl or aryl optionally substituted by alkyl groups, preferably $C_7$ to $C_{14}$-alkylphenyl, x and y are hydrogen or methyl, but are not methyl at the same time, n is a number of from 0 to 20, preferably from 0 to 5, Z is a group of formula $-(CH_2)_mCOOMe$, $-SO_3Me$ or $-PO_3Me_2$, m is an integer of from 0 to 3, and Me is an alkali metal or ammonium ion, as well as optionally further common auxiliaries and additives.

The glycerol ether derivatives of formula IV are known from German Offenlegungsschrift No. 1,256,640 and British Pat. No. 1,370,916.

This combination of compounds I, II and III with a compound of formula IV imparts a pleasant and soft feel to any textile material, especially those made from natural or regenerated cellulose, wool, cellulose acetate, cellulose triacetate, polyamide, polyacrylonitrile, polyesters, or polypropylene. Especially advantageous is its use for the after-treatment of terry fabrics and underwear made of cotton. The fabric softeners of the invention are prepared by simply mixing or dispersing the individual components in water. They may contain one compound each of formulae I to III, or a mixture of two or more compounds of these formulae within the ranges as indicated. In the case of a mixture of two or more compounds of formulae I to III, the mixing ratio thereof with one another is not at all critical and may have any value.

The fabric softeners of the invention may also contain further substances and auxiliaries which are either mixed already with the concentrate of the fabric softener or are added separately to the ready-to-use dilute composition. These are substances or auxiliaries which are conventionally used in softening compositions; they include, for example, cationic and nonionic surface-active substances, electrolytes, neutralizing agents, organic complexing agents, optical brighteners and solubilizers, as well as dyestuffs and perfumes. Additives of this kind serve, for example, to further influence the feel of the fabric or other properties of the textile goods to be treated, or the adjustment of the viscosity or pH or further promote the stability of the solutions at low temperatures.

The fabric softeners are applied as usual, that is, they are added to the last rinsing water after the washing operations are complete. The textiles so treated are subsequently dried, the rewettability of the textile material thus being markedly improved as compared with commercial agents.

In the following Examples, some fabric softeners of the invention have been described. The percentages are in all cases percent by weight. These fabric softeners are in all cases prepared by simply mixing aqueous solutions of the individual components with agitation under heat for Example 1 and in the cold for Examples 2 and 3.

EXAMPLE 1

| | |
|---|---|
| Distearyldimethylammonium chloride | 5% |
| Na salts of the sulfuric acid semiester of glycerol-1,3-diisooctyl ether | 1% |
| Non-ionic surfactant nonylphenol oxethylate + 10 ethylene oxide units | 1% |
| Dyestuff, perfume, water remainder | ad 100% |

EXAMPLE 2

| | |
|---|---|
| Di-tallow fatty alkyl-dimethylammonium chloride | 5% |
| Na salt of the sulfuric acid semiester of a glycerol-1-octyl-3-octadecyl ether | 1% |

-continued

| | |
|---|---|
| Non-ionic surfactant oleyl alcohol + 12 ethylene oxide units | 1% |
| Dyestuff, perfume and water remainder | ad 100% |

EXAMPLE 3

| | |
|---|---|
| Dialkyl imidazoline derivative of formula II, $R = C_{16}$–$C_{18}$—alkenyl, $R_2 = CH_3$, $A = CH_3OSO_3^{\ominus}$ | 5% |
| Na salt of the sulfuric acid semiester of glycerol-1,3-dioctyl-2-octa-ether sulfate | 1% |
| $C_{12}/C_{15}$ oxoalcohol + 10 ethylene oxide units | 1% |
| Dyestuff, perfume, water remainder | ad 100% |

EXAMPLE 4

| | |
|---|---|
| Comparative formulation | |
| Distearyldimethylammonium chloride | 6% |
| Non-ionic surfactant nonylphenol oxethylate with 10 ethylene oxide units | 1% |
| Dyestuff, perfume, water remainder | ad 100%. |

These fabric softeners were tested for their influence on the rewettability according to the method of capillary rise (German Industrial Standard DIN 53 924).

Smooth cotton fabrics are treated with the mixtures of the invention. A commercial softener (Example 4) was used for comparison. According to this test method, the results listed in the following Table were obtained for the mixtures of Examples 1 to 4. The capillary rise of unfinished fabrics is defined as being 100%.

| | Rise in % | |
|---|---|---|
| | 1 g of FS/kg of fabric | 2 g of FS/kg of fabric |
| Example 1 | 65% | 58% |
| Example 2 | 68% | 60% |
| Example 3 | 65% | 55% |
| Example 4 (Compar. form.) | 54% | 48% |

The results show that the fabric softener combinations of the invention have an improved absorption capacity as compared against a commercial product.

What is claimed is:

1. Fabric softeners in the form of an aqueous solution or dispersion, which contain from 3 to 15% by weight of one or several compounds of formulae I to III

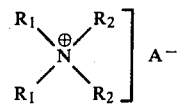

I

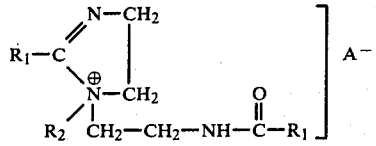

II

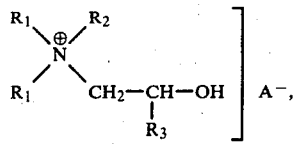

III in which $R_1$ is alkyl or alkenyl each with 10 to 30 carbon atoms, $R_2$ is alkyl of from 1 to 4 carbon atoms, $R_3$ is methyl or hydrogen, and A is an anion, from 0.1 to 3%by weight of a glycerol ether derivative of formula IV

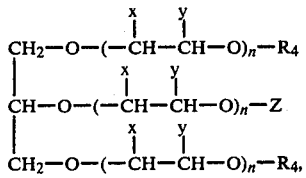

IV in which $R_4$ is alkyl or alkenyl each with 4 to 20 carbon atoms, cyclohexyl or aryl optionally substituted by alkyl groups, x and y are hydrogen or methyl, but are not methyl at the same time, n is a number of from 0 to 20, Z is a group of formula $—(CH_2)_mCOOMe$, $—SO_3Me$ or $—PO_3Me_2$, m is an integer of from 0 to 3, and Me is an alkali metal or ammonium ion, as well as optionally further auxiliaries and additives.

2. Fabric softeners as claimed in claim 1, which contain from 3 to 15% by weight of one or several compounds of formulae I to III, in which $R_1$ is alkyl or alkenyl each with 8 to 14 carbon atoms, $R_2$ is methyl, $R_3$ is methyl or hydrogen, A is $Cl^{\ominus}$, $Br^{\ominus}$, $CH_3OSO_3^{\ominus}$ or $(CH_3O)_2PO_2^{\ominus}$, from 0.5 to 1.5% by weight of a glycerol ether derivative of formula IV wherein $R_4$ is alkyl or alkenyl each with 8 to 16 carbon atoms, cyclohexyl or $C_7$–$C_{14}$-alkylphenyl, n is a number of from 0 to 20 and x, y, Z, m and Me are as defined in claim 1.

3. Fabric softeners as claimed in claim 1, which contain from 4 to 7% by weight of one or several compounds of formulae I, II or III and from 0.5 to 1.5% by weight of a glycerol ether derivative of formula IV.

* * * * *